US006792881B2

(12) United States Patent
Smith

(10) Patent No.: US 6,792,881 B2
(45) Date of Patent: Sep. 21, 2004

(54) METHOD FOR CLEANING SALT IMPREGNATED HOG FUEL AND OTHER BIO-MASS, AND FOR RECOVERY OF WASTE ENERGY

(76) Inventor: Peter W. Smith, 2054 Bennett Road., Kelowna, British Columbia (CA), V1V 2C2

( * ) Notice: Subject to any disclaimer, the term of this patent is extended or adjusted under 35 U.S.C. 154(b) by 0 days.

(21) Appl. No.: 10/603,778

(22) Filed: Jun. 26, 2003

(65) Prior Publication Data

US 2004/0002028 A1 Jan. 1, 2004

Related U.S. Application Data

(60) Provisional application No. 60/391,552, filed on Jun. 26, 2002.

(51) Int. Cl.[7] ..... F23B 7/00

(52) U.S. Cl. ..... 110/342; 110/348; 110/218; 110/219

(58) Field of Search ..... 110/262, 218, 110/219, 342, 345, 348

(56) References Cited

U.S. PATENT DOCUMENTS 4,277,362 A * 7/1981 Mallek et al. ..... 588/2
4,304,571 A * 12/1981 McMahon ..... 44/608
4,363,264 A 12/1982 Lang et al.
4,473,459 A * 9/1984 Bose et al. ..... 208/391
4,532,873 A * 8/1985 Rivers et al. ..... 110/347
4,589,357 A * 5/1986 Lincoln et al. ..... 110/347
4,928,606 A * 5/1990 Mullen ..... 110/347
4,961,865 A 10/1990 Pennartz
5,028,299 A 7/1991 Guidat et al.
5,075,017 A 12/1991 Hossain et al.
5,624,699 A 4/1997 Lang
5,685,153 A * 11/1997 Dickinson et al. ..... 60/648
5,738,003 A 4/1998 Lang
6,401,635 B1 * 6/2002 Nieminen et al. ..... 110/342

* cited by examiner

*Primary Examiner*—Kenneth B. Rinehart
(74) *Attorney, Agent, or Firm*—Antony C. Edwards

(57) ABSTRACT

A method according to the present invention for reducing the creation of dioxins during the burning of a biomass containing a contaminant, wherein the contaminant is solvated or neutralized in the presence of a corresponding solvent, includes the steps of prior to the burning or reacting (herein collectively referred to as burning) of the biomass, conveying the biomass and the solvent into a biomass washing means, washing the biomass in the solvent in the washing means, and once at least a portion of the contaminant has been washed from the biomass, conveying the biomass from the washing means and into a biomass burner, and conveying the solvent from the washing means.

18 Claims, 12 Drawing Sheets

Solubility of Salt NaCl in water
Grams of anhydrous salt in 100 grams of water vs temperature.

| Temp C | 0 | 10 | 20 | 30 | 40 | 50 | 60 | 70 | 80 | 90 | 100 |
|---|---|---|---|---|---|---|---|---|---|---|---|
| Solubility | 35.70 | 35.80 | 36.00 | 36.30 | 36.60 | 37.00 | 37.30 | 37.80 | 38.40 | 39.00 | 39.80 |

Ref: Perry's Chemical Engineers Handbook Seventh Edition Table 2-120 P 2-123
Mc Graw Hill 1997

Figure 7

METHOD FOR CLEANING SALT IMPREGNATED HOG FUEL AND OTHER BIO-MASS, AND FOR RECOVERY OF WASTE ENERGY

CROSS REFERENCE TO RELATED APPLICATION

This application claims priority from U.S. Provisional Patent Application No. 60/391,552 filed Jun. 26, 2002 entitled A Method for the Reduction of Dioxin Creation in Pulp Mills and Recovery of Waste Energy.

BACKGROUND OF THE INVENTION

Interest in the utilization of renewable biomass resources as fuels is growing against a background of worldwide depletion of fossil fuels, and emissions of greenhouse gases from fossil fuel combustion.

Whilst some processes can handle large volumes of biomass directly as fuels, the convenience of liquid fuels has led to the emergence of technology to convert biomass into liquids, effectively bio-oil.

Biomass as harvested typically contains impurities or compounds that can affect its processing, or cause serious equipment fouling and/or additional emissions The cleaning of biomass to remove undesirable impurities and compounds that cause processing issues and emissions is difficult to achieve economically, and is a hindrance to the development and expansion of biomass utilization processes. The impurities and undesirable compounds may be solids that cause excessive equipment wear and maintenance, or may be dissolved or occluded compounds that have similar effects and which also, in processing of combustion, generate serious emissions and pollution, or may be compounds contained within the biomass. Such compounds include fertilizer and other residues from minerals absorbed by the biomass during its growth. These compounds typically end up in ash when the biomass is combusted, but may cause fouling and high maintenance costs in conversion processes.

The conversion of biomass into either energy by combustion or other products with various processes is imperfect, and results in a certain amount of wastage, normally in the form of waste heat. The waste heat is typically lost in the form of warmed-up coolant, often warm water. One such example of biomass use as a fuel is the burning of "Hog Fuel" by pulp and paper mills.

Pulp mills utilize the outer layers of logs, mainly bark but also small branches and leaves, also sawdust, (commonly called "Hog Fuel") as fuel for their boilers. When the hog fuel has been immersed in sea water, for example when the raw logs are delivered floating in sea-water, then the outer layers absorb salt water. The hog fuel produced from such sources contains substantial quantities of salt, typically 0.9% up to 2% by weight, and also sand and other debris.

The salt enters the boilers with the hog fuel, and is emitted as salt crystals or converted by chemical reaction into a variety of inorganic and organic compounds including salt cake, dioxins and furans. These materials cause corrosion of the boiler, and also constitute a major source of pollution. "Dioxin" is a general term that describes a group of hundreds of organo-chlorine chemicals, some of the most toxic compounds known, that are highly persistent in the environment. "Furans" are also long-lived organo-chlorine compounds with carcinogenic and other undesirable environmental impacts. Dioxin has been described by the US Environmental Protection Agency as a serious public health threat. The International Agency for Research on Cancer (IARC, part of the World Health Organization, considers one dioxin as a Class I carcinogen. The combustion of salty hog fuel causes major emissions of dioxins.

Pulp and paper mills also produce and utilize large quantities of warm and hot water in their pulping operations. There is a net excess of such heated water, and this must go to disposal, causing thermal pollution, a waste of energy and through this additional greenhouse gases emissions.

Efforts to reduce dioxin pollution from mills to date have been directed towards capture of the dioxin, its reduction through chemical injection into the boiler where it is formed, and the use of special boiler designs or boiler operations. These methods do not avoid the formation of, or eliminate the dioxin or salt emissions, and in some cases add another pollutant from the injected materials. There is also evidence that precipitators commonly used to capture particulates in boiler flue gases provide just the right conditions to form more dioxins. The ash produced on boilers burning hog fuel containing salt also contains concentrations of dioxins. The ash containing dioxins is regarded as hazardous waste and normally goes to special lined landfills.

SUMMARY OF THE INVENTION

The method of the present invention, in contrast, inhibits or reduces, in one aspect, the formation of dioxins by removing the chlorine-containing contaminant (for example salt or NaCl) from hog fuel including mulched bark before it is burned. The method also prevents salt emissions from boiler stacks by removing the salt from the hog fuel before it enters the boilers. The salt, containing chlorine, may be returned to the sea. The invention is however broader in application than to only the solvating of salt from hog fuel in the presence of warm or hot water. Contaminants may be other than salt so long as the corresponding solvent or reactant, whether chemical or biological, required to neutralize or remove the particular contaminant is employed in the method. Consequently, it is intended herein that reference to contaminants is to be interpreted to include more than merely salt, and that reference to solvent is to include more than merely water and is to include solvent or other reactants corresponding to the particular contaminant, and therefore that reference herein to burner is to include both combustors and reactors.

This invention relates in one application of the method to the removal of salt from hog fuel by contacting the hog fuel with excess warm or hot water streams generated in a pulp mill, which streams commonly pass from the mill as effluent, or otherwise water from an outside source for use in salt extraction.

The method may employ counter current diffusion extraction equipment of any suitable configuration that will provide both mass and heat transfer. The extraction equipment may be used in a horizontal, vertical or inclined plane. In particular, the method according to the present invention may employ means of bringing hog fuel and water, into intimate contact, by using various types of extraction equipment, counter-current extraction, pipelines, fluid-beds, cyclones, cross-flow devices pulsed extractors, filters or extractors purpose-built to provide the means of mass and heat transfer, or any other contacting device or combinations of the above.

The method of the present invention is for the avoidance or reduction of dioxin creation by, for example, counter-flow washing of salt from hog fuel, and for the simultaneous recovery of waste energy. The method may be employed using:

(i) a mass flow conveyor, such as a screw conveyor, having an infeed and an opposite outfeed, providing a pre-selected number of mass and heat transfer stages so as to provide for efficient and economic operation and (ii) a water source, The method of comprising the steps of:

(a) feeding cold salt-laden hog fuel into said infeed of said conveyor, (b) translating said hog fuel along said conveyor in a first direction towards said hog fuel outfeed, (c) simultaneously feeding solvent into intimate intermingling or turbulent contact with said hog fuel in or on said conveyor, for example so as to cause a water flow in a second direction counter to said first direction in a counter-flow of said water through said translating hog fuel, (d) extracting, salt-laden solvent following said contact and, extracting de-salted hog fuel via said hog fuel outfeed.

In one preferred embodiment the solvent, at least in part, is warm or hot effluent water. In alternative embodiments, the conveyor is a screw conveyor or may be other mass-flow conveyor means for conveying said hog fuel in said first direction from said infeed to said outfeed so long as said mass-flow conveyor means provides for, or is adapted to provide, interaction of said hog fuel (or other mineral laden mass flow) for example in counter or cross flow with said water flowing in said second direction for flushing and dissolving said minerals from said mass flow on said conveyor means and for heat exchange of energy from the water to the mass flow.

In summary, the method according to the present invention for reducing the creation of dioxins during the burning of a biomass containing a contaminant, wherein the contaminant is solvated or neutralized in the presence of a corresponding solvent, includes the steps of:

a) prior to the burning or reacting (herein collectively referred to as burning) of the biomass, conveying the biomass and the solvent into a biomass washing means, b) washing the biomass in the solvent in the washing means, and c) once at least a portion of the contaminant has been washed from the biomass, conveying the biomass from the washing means and into a biomass burner, and conveying the solvent from the washing means.

In one application of the method according to the present invention the biomass is hog fuel, the contaminant is salt, and the solvent is water. The method further advantageously includes the step of supplying water to the washing means by diverting an effluent stream of heated waste water, for example from a pulp or paper mill, so that the heated waste water provides the solvent. Salt is thereby reduced or no longer passes into the burner, again wherein the burner includes combustors or reactors, and wherein stack gas precipitators collecting the particulate solids operate at lower loadings as the salt is diverted from them so as to improved combustor operations. The heated waste water may be supplied into the washing means at a first temperature and the biomass may be fed into the washing means at a second temperature, where the first temperature is higher than the second temperature so that the biomass cools the waste water in the washing means. The result is a reduction in energy consumption in pulp and paper mills and biomass processors achieved through warming of incoming fuel by recovery of waste heat from the effluent stream. In such applications, advantageously the diverting of the heated waste water is diverting of heated waster water as diverted effluent from effluent from a pulp or paper mill, and wherein the pulp or paper mill is the mill in which the biomass is to be burned, so that the diverted effluent is cooled before being disposed of in a disposal step, for example, into the ocean.

In one aspect of the present invention the washing means may be a counter-current extractor such as a screw conveyor, and the washing may include counter-current intermingling of the solvent with the biomass.

In some applications the biomass may also contain solid particulate contaminants, in which case the method according to the present invention may further include the step of removing the particulate contaminants by vibration of the solvent and biomass in the washing means.

The method according to the present invention may further include providing an underflow conveyor cooperating with the counter-current extractor for the removing step so as to remove of the particulate contaminant from the washing means.

In applications where the biomass is wood knots coated in chemicals rejected from a pulping process, the method according to the present invention may include the steps of recovering the chemicals using a minimum flow of solvent, wherein solvent and chemicals pass out of a washing stage and are transported to a recovery system, whereby cleaned wood knots are made available for use as fuel.

In a further aspect of the present invention, during the washing of the biomass an additional stream of effluent containing mill sludge may also be added into the extractor, whereby fiber in the sludge is retained within the bed of biomass so as to act as a filter, thereby allowing cleaned water from the sludge to pass out of the washing stage along with the washing water.

BRIEF DESCRIPTION OF THE DRAWINGS

FIG. 7 is a reference table of sodium chloride solubility in water.

DETAILED DESCRIPTION OF EMBODIMENTS OF THE INVENTION

Figure 1:
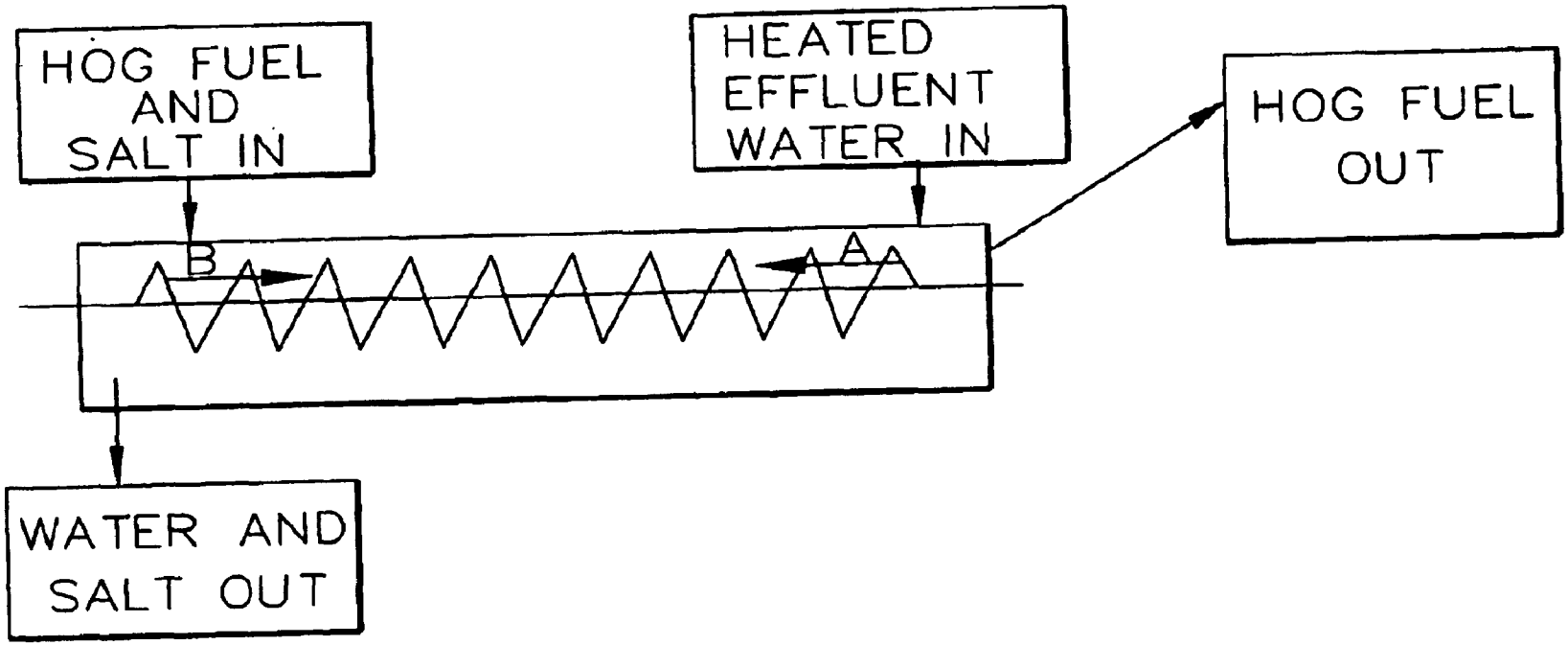
FIG. 1 is a diagrammatic view of the counter current extraction according to the method of the present invention.
Figure 2:
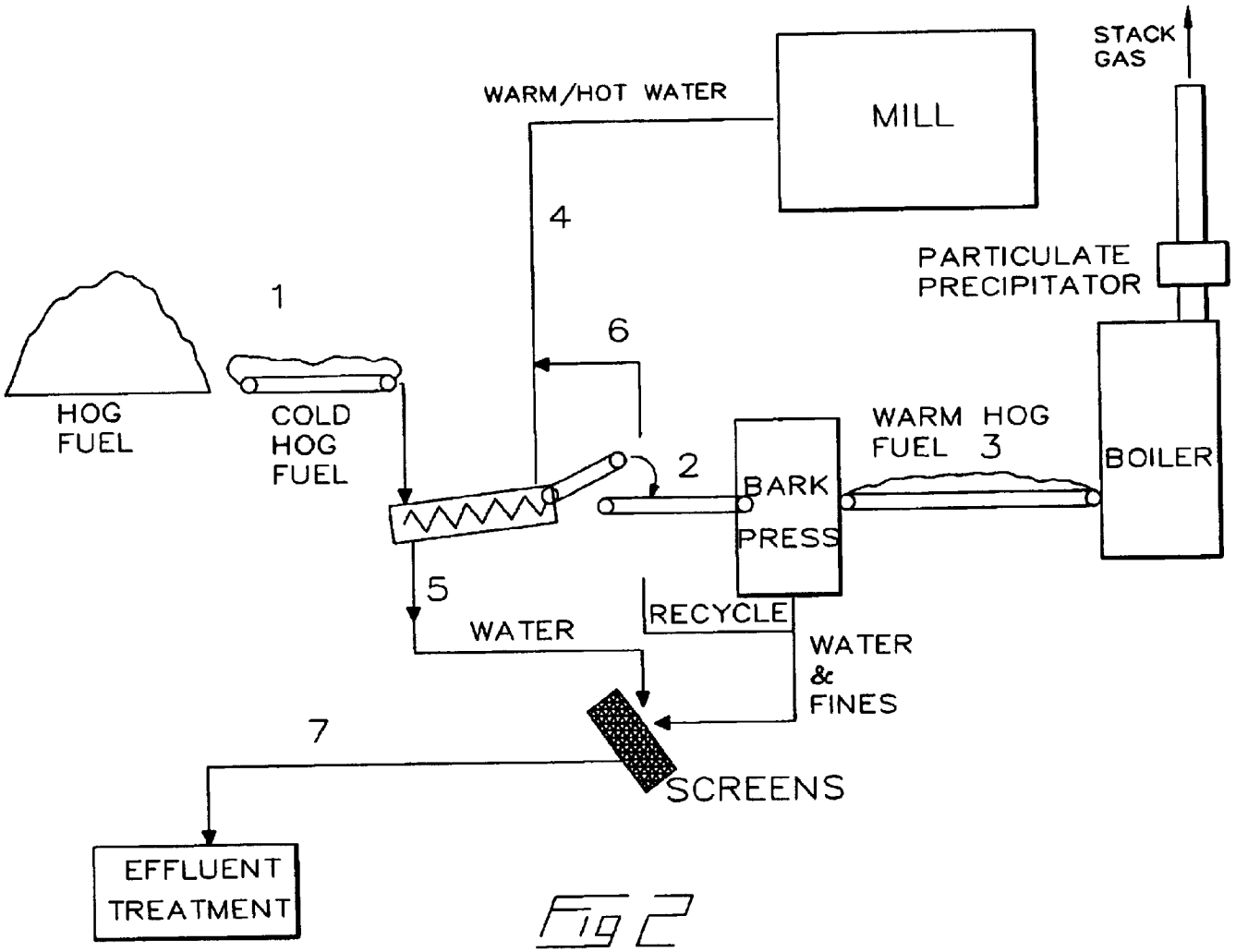
FIG. 2 is a diagrammatic view of the counter current extraction of FIG. 1 incorporated into typical mill operation according to the method of the present invention.
Figure 2A:
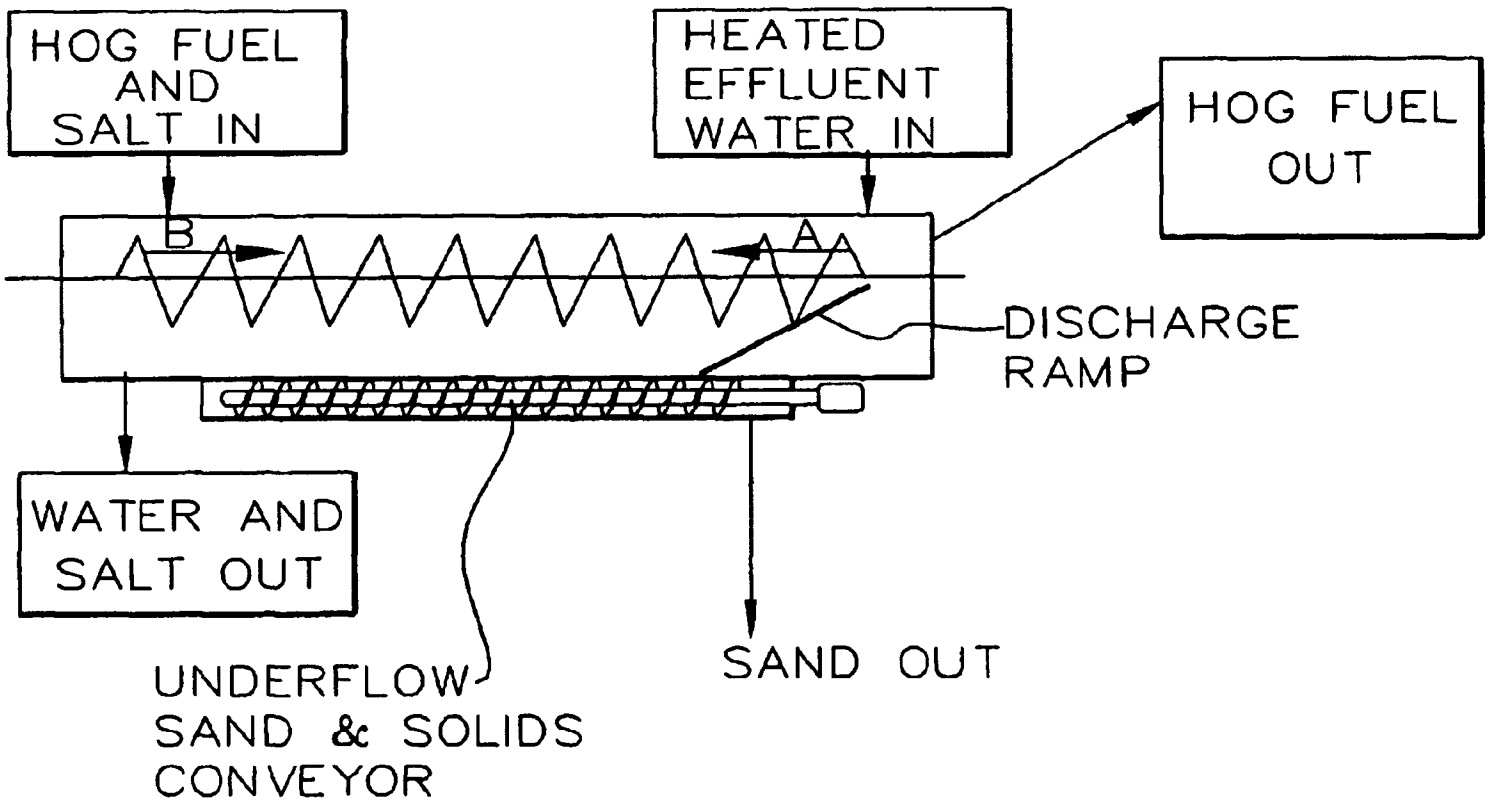
FIG. 2*a* is a diagrammatic view of the counter current extraction of FIG. 1, equipped with a sand removal device.

One embodiment of the process of removing salt from hog fuel according to the present invention is illustrated in FIGS. 1 and 2.

Counter current extraction is conducted using a counter-current extractor (CCE). The CCE is a high efficiency solid-liquid contacting device. The CCE typically contains fourteen virtual mass transfer stages within one casing and as such requires far less solvent for the extraction of solids than alternative mass transfer devices. It may be installed at an angle. Solid feed hog fuel enters at the bottom and is discharged at the raised top end. If inclined the CCE is thus self-draining. The internal rotor, screw or auger acts in a pulsating water flow in direction A, with the hog fuel propelled in direction B up the slope until it exists through an elevator system (see FIG. 2) that provides self-draining of excess water. Alternatively the hog fuel may be moved out of the CCE up an inclined plane or ramp The interaction of the counter-flow of water through the hog fuel being translated allows the salt to be washed from the hog fuel. The water containing the salt passes through a screen at the lower end of the rotor housing, then over a weir before discharge.

To restate then briefly, as hog fuel is passed in counter-current flow to water in the CCE, the salt in the hog fuel is diffused into the water stream and the desalted hog fuel exits the CCE and then is passed to the boilers or combustors. The incoming hog fuel typically also contains sand and other debris that also causes wear and subsequent higher maintenance costs on bark presses, boiler tubes and other pulp mill equipment. The action of washing the hog fuel in the pulsating flow used in the CCE also dislodges the sand and other debris present in the hog fuel.

This debris, especially sand, falls to the bottom of the CCE, where it may be removed using an additional screw conveyor or other suitable material handling device. Alternatively the sand and debris may be removed in a settler, cyclone or other suitable device before or after the hog fuel enters the salt extraction stage.

The hog fuel is thus cleaned of both salt and solid debris, providing environmental benefits and cost advantages to process operations from lower maintenance of equipment.

The removal of salt also reduces the loading on boiler stack gas precipitators, allowing greater amounts of hog fuel to be burned in place of gas or other fossil fuels. At present, fossil fuels are typically used during combustion of salty hog fuel to assist operators in meeting official environmental regulatory emissions limits for particulates as well as dioxins.

There may be an additional stage of pressing the hog fuel to reduce its water content prior to firing it in the boiler. As the salt has been removed, there is no chlorine in the boiler, corrosion is greatly reduced and no dioxins can be formed.

In addition to providing counter current diffusion extraction, the CCE also provides the additional functions of filtration and heat exchange. The bed of hog fuel acts as its own filter, and thus fines that occur in the hog fuel are largely kept within the solid bed.

This filtration capability may also be employed to recover fiber from pulp mill effluent streams, thus simultaneously recovering waste fiber as part of the fuel stream, and eliminating the requirement for effluent treatment.

The CCE also acts as a very efficient direct-contact heat exchanger. The hog fuel is warmed by the effluent water used to wash out the salt as the hog fuel progresses through the CCE along the screw conveyor, the salt extraction water being cooled simultaneously.

In one example, as seen in FIG. 2, hog fuel, (1) containing 55% water at ambient temperature (at 15 C for this example) is conveyed from the mill stock-pile at a typical rate of 200 $m^3$/hr, or 202 tonnes/hr to the counter-current washing system. The incoming hog fuel will typically pass through a magnetic separator where magnetic debris is removed, and may also pass across or through screens, cyclones or other suitable separator for removal of sand and additional debris or for control of the size range of hog fuel prior to its further processing or use.

This hog fuel typically contains up to 2% salt, but this may vary from nil to over 2%, depending on how long the logs from which the hog fuel are derived have been left in salt water. In this example it is assumed that the hog fuel contains 2% salt. Although salt (NaCl) is the primary constituent derived from salt water immersion, other minerals derived from salt water will also be present in smaller quantities. In the context of this invention salt NaCl and other minerals containing chlorine and other halogens together will be referred to as "salt".

The 200 $m^3$/hr of hog fuel, containing about 4000 kg/hr of salt, enters the extraction system where it meets a counter-flow of water, typically warm or hot effluent water produced in the mill. For this example, hot mill water (4) at 55 C, at a rate of 206 $m^3$/hr is sent to the water inlet of the extractor. Much of this water is surplus to the mill's requirements. This water may or may not have particles and other minerals present. This surplus would normally be disposed by mills through effluent treatment systems causing thermal pollution when the effluent is discharged into the sea or other disposal areas. The counter-flow heat exchange with the hog fuel on the screw conveyor reduces such thermal pollution by the cooling of the water by heat exchange with the hog fuel wherein the incoming water is brought into intimate contact with the hog fuel in counter-current flow. Salt, NaCl, is very soluble (35.7%) in cold water, and even more soluble in hot water (FIG. 7). The water diffuses into the pores of the hog fuel, and dissolves the absorbed salt. The counter-flow of water flushes or sweeps the dissolved salts out of the hog fuel. The salt laden water then exits the extractor, and is sent to the effluent treatment system. The hog fuel bed, traveling against the flow of water, forms its own filtration bed. This assists in capturing fines that occur as part of the hog fuel, or come into the extractor with the water stream. Additional means of controlling fines with self-cleaning screens or filters may be included in the extractor or as a secondary separation stage, to provide a final safeguard to recover hog fuel fines. The salt laden water exiting the extractor passes to disposal via the mill effluent treatment unit that also normally has a set of screens on its own untreated water inlet.

The CCE may be equipped with one or more recycle streams, heating or cooling jackets and/or internal parts to provide facilities for fine control of the process. (As described in the basic CCE art).

The counter current extraction system acts as a very efficient direct-contact heat exchanger as the cold hog fuel is warmed by the counter-flowing water. In this example, the de-salted hog fuel, containing 65% water exits the extraction system at a temperature of 55 C The hog fuel (2) then goes to bark presses known in the art or a similar mechanical dewatering system, common on pulp mills, where its water content is reduced to 55%. The warm desalted hog fuel (3) then goes to the boiler for firing. Less fuel is required as the hog is already warmed up. Less fuel consumption means less greenhouse gases.

Warm water removed from the hog fuel in the bark presses (6) may be recycled through the CCE, so that energy and fines are recovered.

Figure 3:
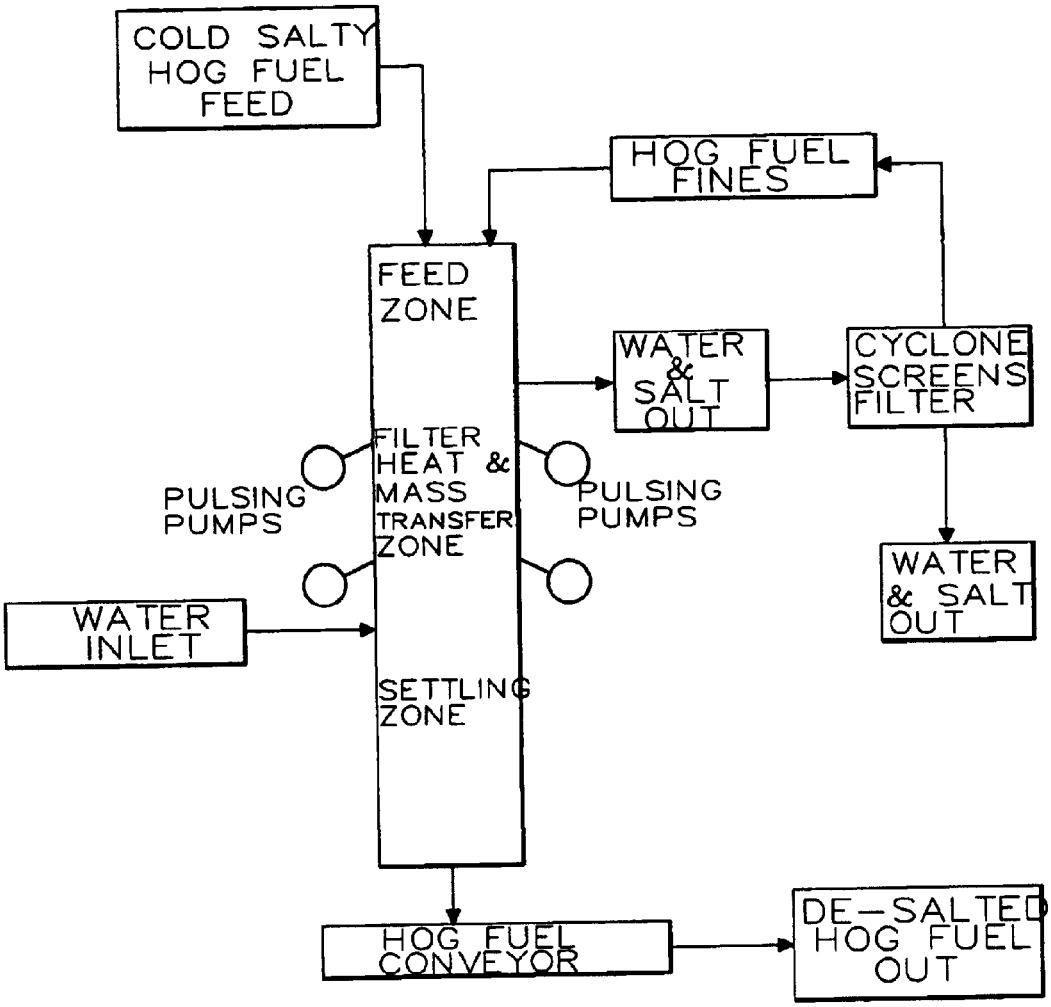
FIGS. 3–5 are alternative embodiments of the method according to the present invention.

An alternative embodiment of the invention is indicated in FIG. 3. In this case, a column type contactor has been substituted for the CCE. This extraction device also works in Counter-Current mode, with the hog fuel and water in counter-flow. The contactor may work in a fluidized or non-fluidized mode.

Provision is made for removal of sand and other solid debris from the column contactor by means of a screw conveyor or other suitable solids handling device.

Figure 4:
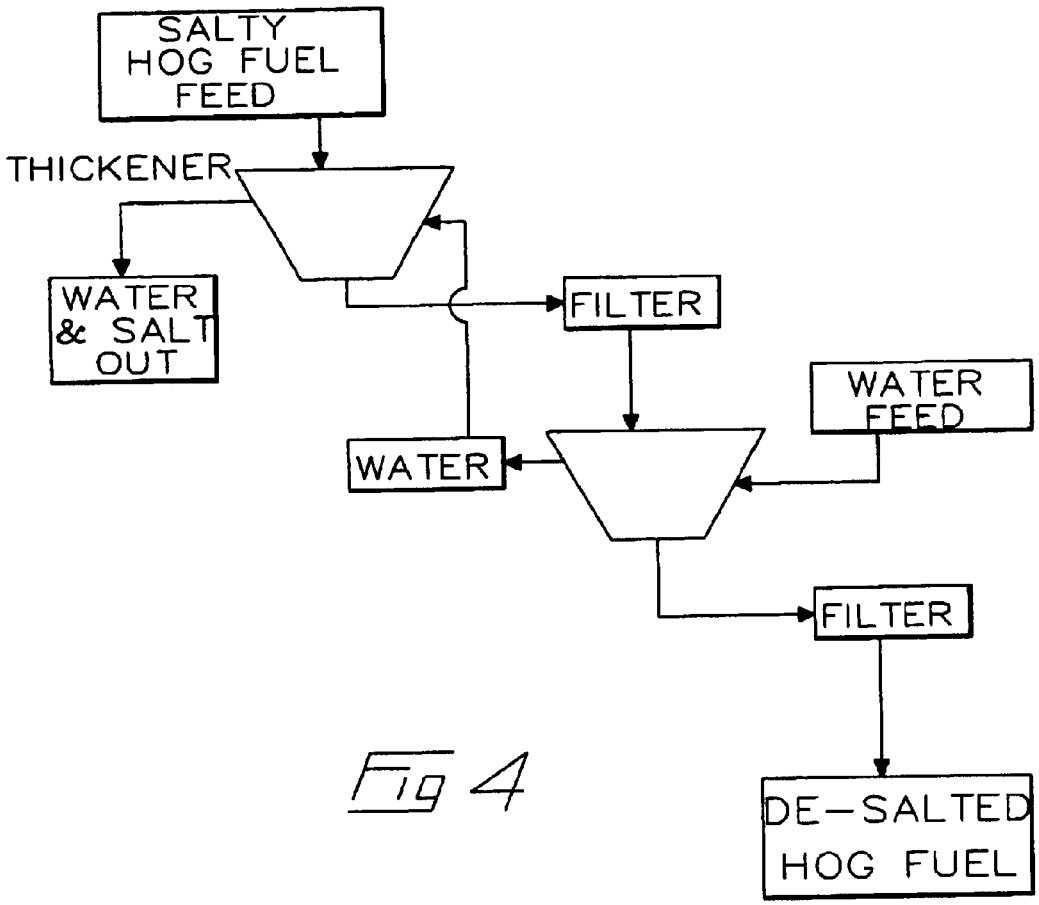

An additional embodiment of the invention is indicated in FIG. 4. In this case, one or more pipelines with the hog fuel and water in co-current flow is used as the primary hog fuel-water contactor. Separation of the hog fuel and water is effected in a further separation stage that may be provided by screens, filters or settling tanks. In this case, there is a transfer of salt from the hog fuel into the water that reduces the salt content of the said hog fuel to reduce but not completely eliminate the salt and hence dioxin generation.

Additional pipelines and filter stages may be added and salt diffusion process repeated until substantially all of the salt is removed from the hog fuel.

In this case, cyclones, settling tanks and screw conveyors or other suitable means of removing sand and other solid debris will be included in the process.

Figure 5:
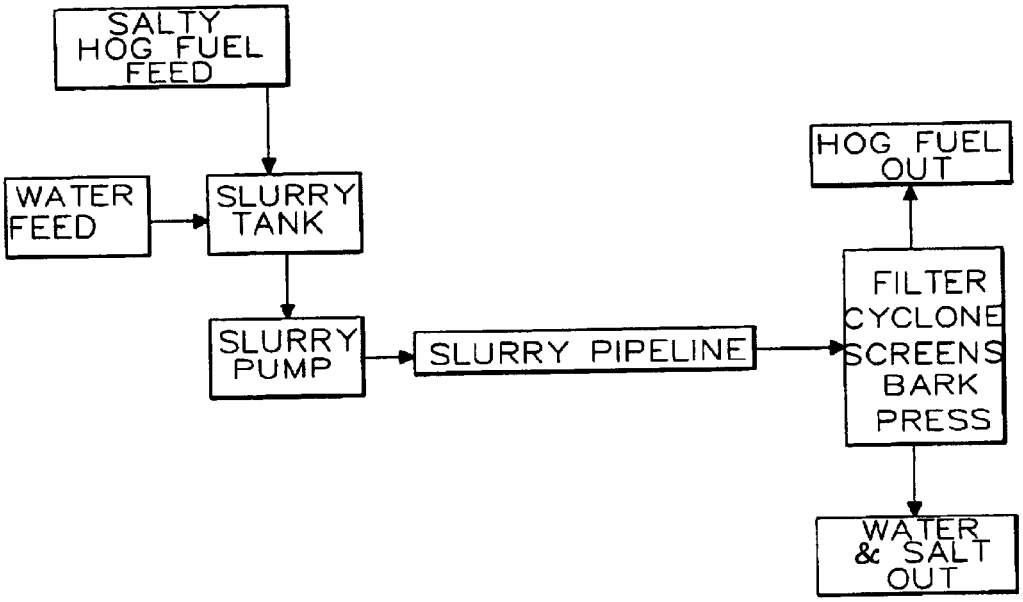

A further embodiment of the invention is indicated in FIG. 5. In this case one or more thickeners are used to contact the said hog fuel with water. The salt in the hog fuel diffuses into the water stream. If sufficient thickeners are used, almost complete removal of salt from said hog fuel may be obtained.

Provision will be made for the removal of sand and other solid debris with an underflow screw conveyor, cyclone or other suitable solids separation device.

Figure 6:
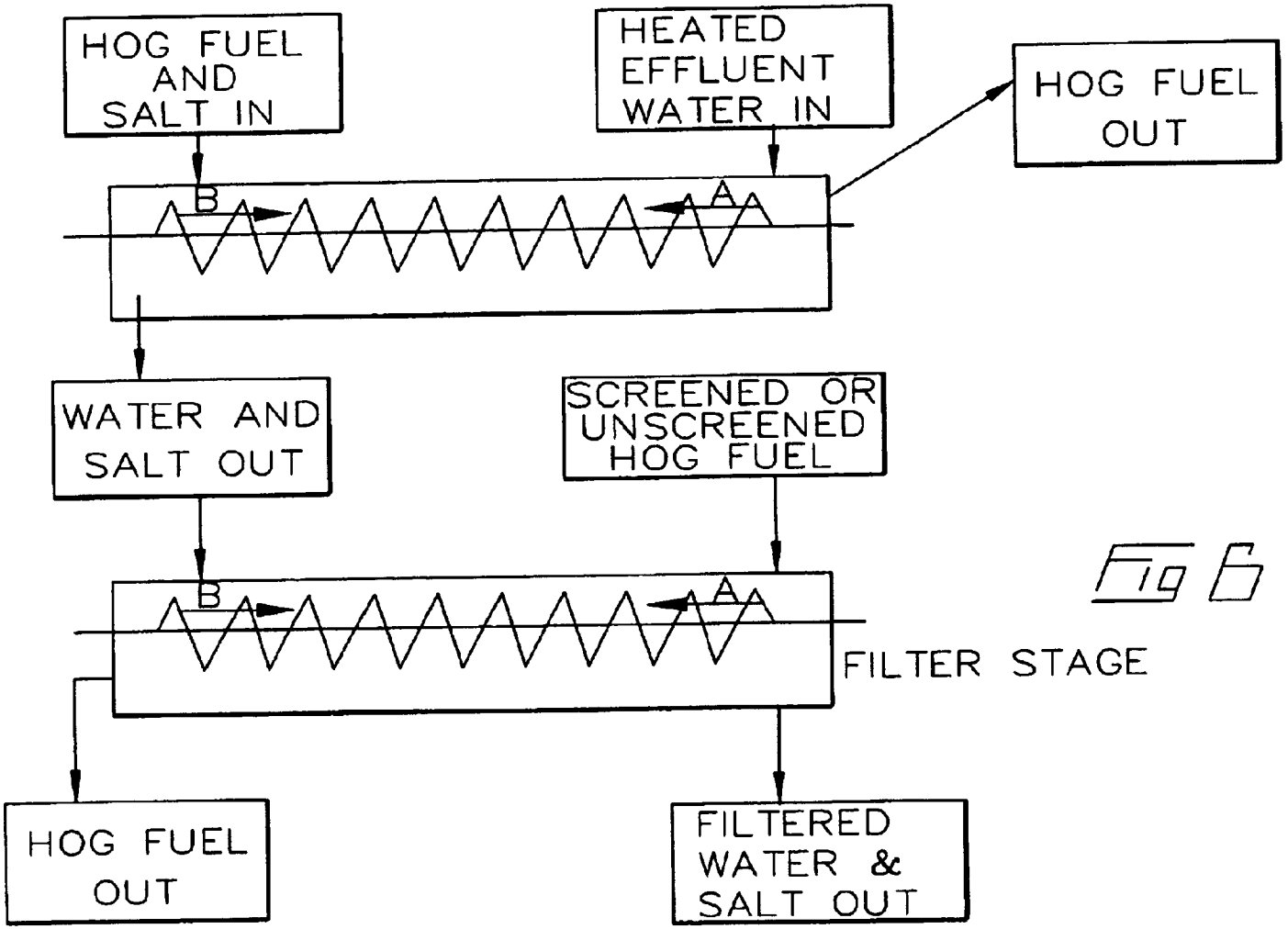
FIG. 6 is a diagrammatic view of a two stage counter current extraction and filtration.

A further embodiment of the invention is indicated in FIG. 6. In this case two CCE stages are indicated, although the two stages may be in one casing or two or more casings.

The salt is removed in the first stage, whilst the salty water exiting the first stage then passes to a second stage where it is additionally filtered through hog fuel or other filtration agent to further remove fines from the salty water stream to reduce treatment in effluent treatment systems to the required BOD level prior to discharge to the sea.

Figure 8:
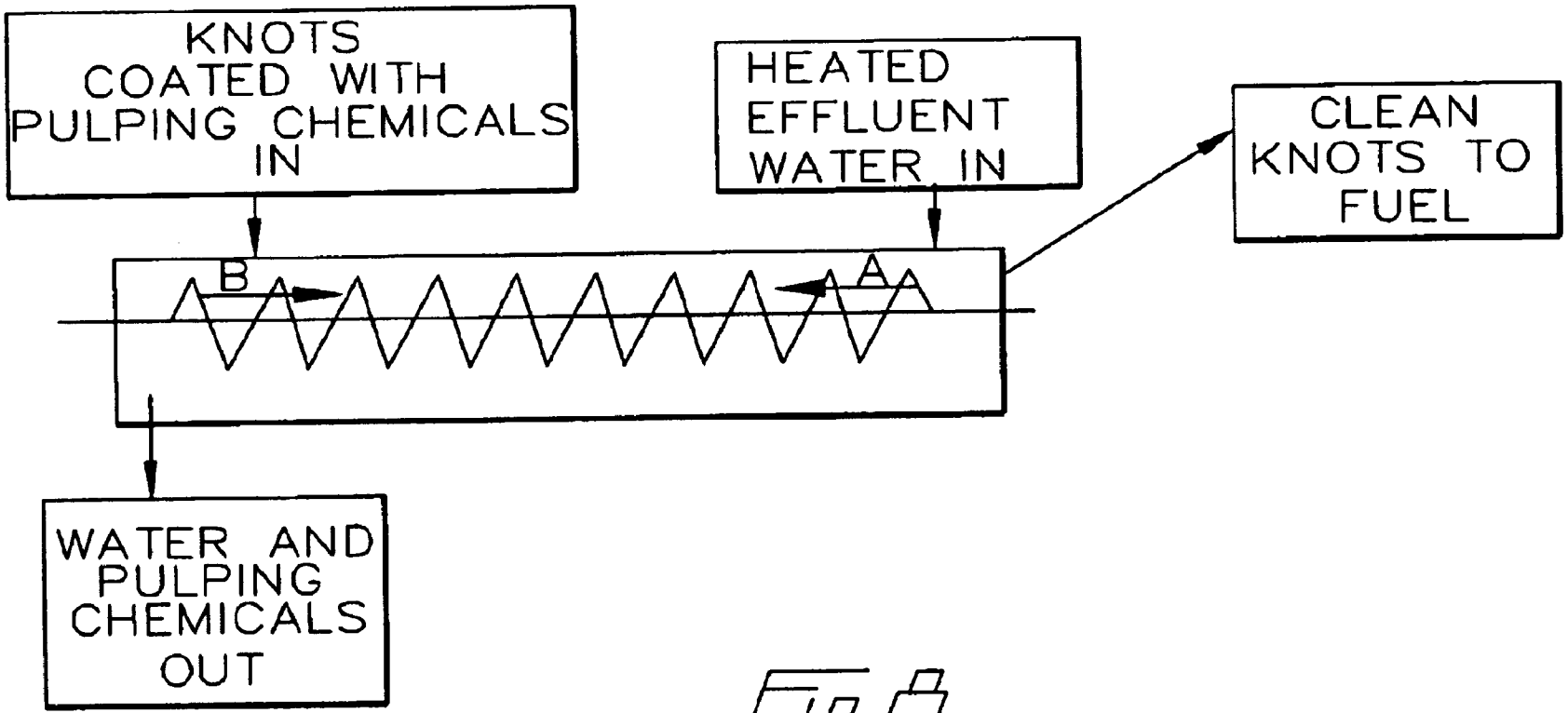
FIG. 8 is a diagrammatic view of an alternative embodiment of the counter current extraction applied to the cleaning of knots by recovery of pulping chemicals.

A further embodiment of the invention is indicated in FIG. 8. Knots rejected from the pulping process, and coated with pulping chemicals are normally stockpiled at mill sites, as the chemicals cause fouling of boilers and other combustors and also environmental pollution if they are fired. These chemical-coated knots are regarded as hazardous waste and form a storage and disposal problem.

In this case knots rejected from the pulping process, are processed in a CCE, where the pulping chemicals present with the knots are recovered in a water stream that may be sent to recovery systems.

The CCE used for extraction of salt from hog fuel may be used intermittently for this service, or a separate smaller CCE may be used for the knot washing service. In either case, the washed knots without chemical coating are available to form part of the cleaned hog fuel and may be combusted as part of the hog fuel. Energy recovery may form part of the knot washing application.

Figure 9:
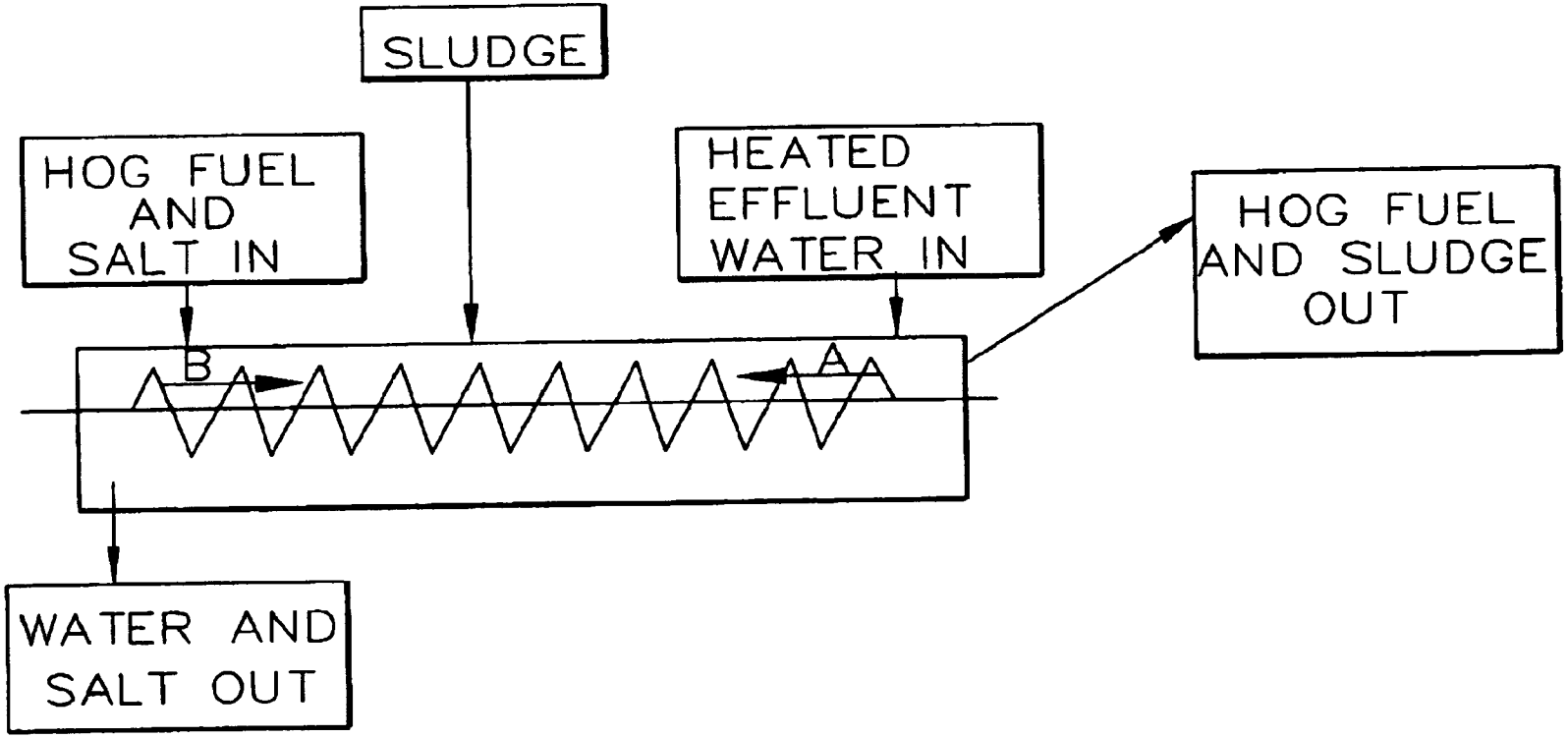
FIG. 9 is a diagrammatic view of an alternative embodiment of the counter current extraction applied to the de-watering of sludge and recovery of the energy value of sludge as part of the hog fuel.

A further embodiment of the invention is indicated in FIG. 9. Sludge produced on pulp mills may be de-watered and its energy value recovered by incorporating it into the hog fuel stream, whereby the filtration properties of the hog fuel bed present in the counter current extractor are advantageously exploited.

Figure 10:
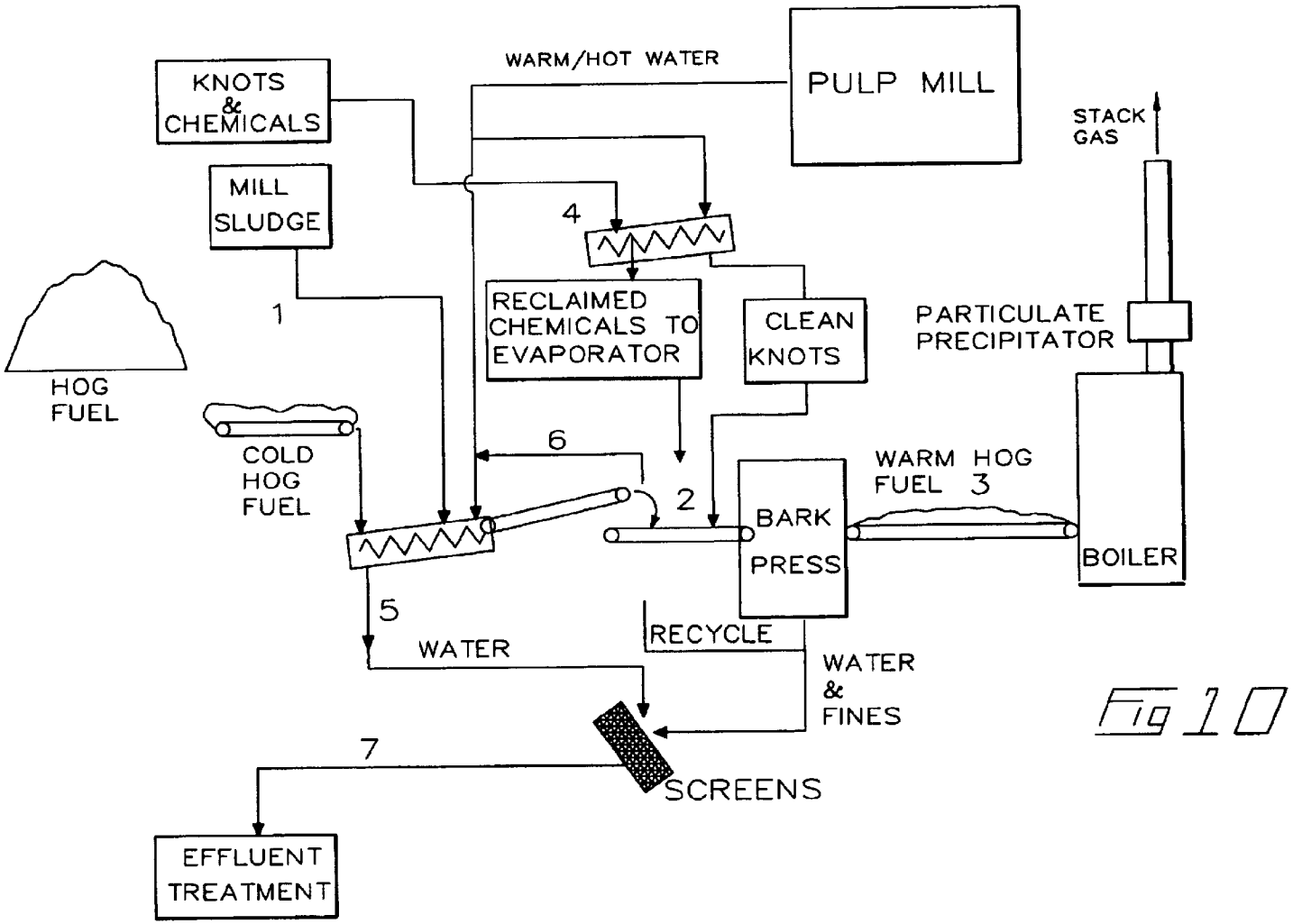
FIG. 10 is a diagrammatic view of various embodiments of the invention incorporated in a typical pulp and paper mill.

The embodiments of the invention to clean hog fuel, recover fiber from sludge and recover chemicals from knots on a typical pulp and paper mill are indicated in FIG. 10.

Figure 11:
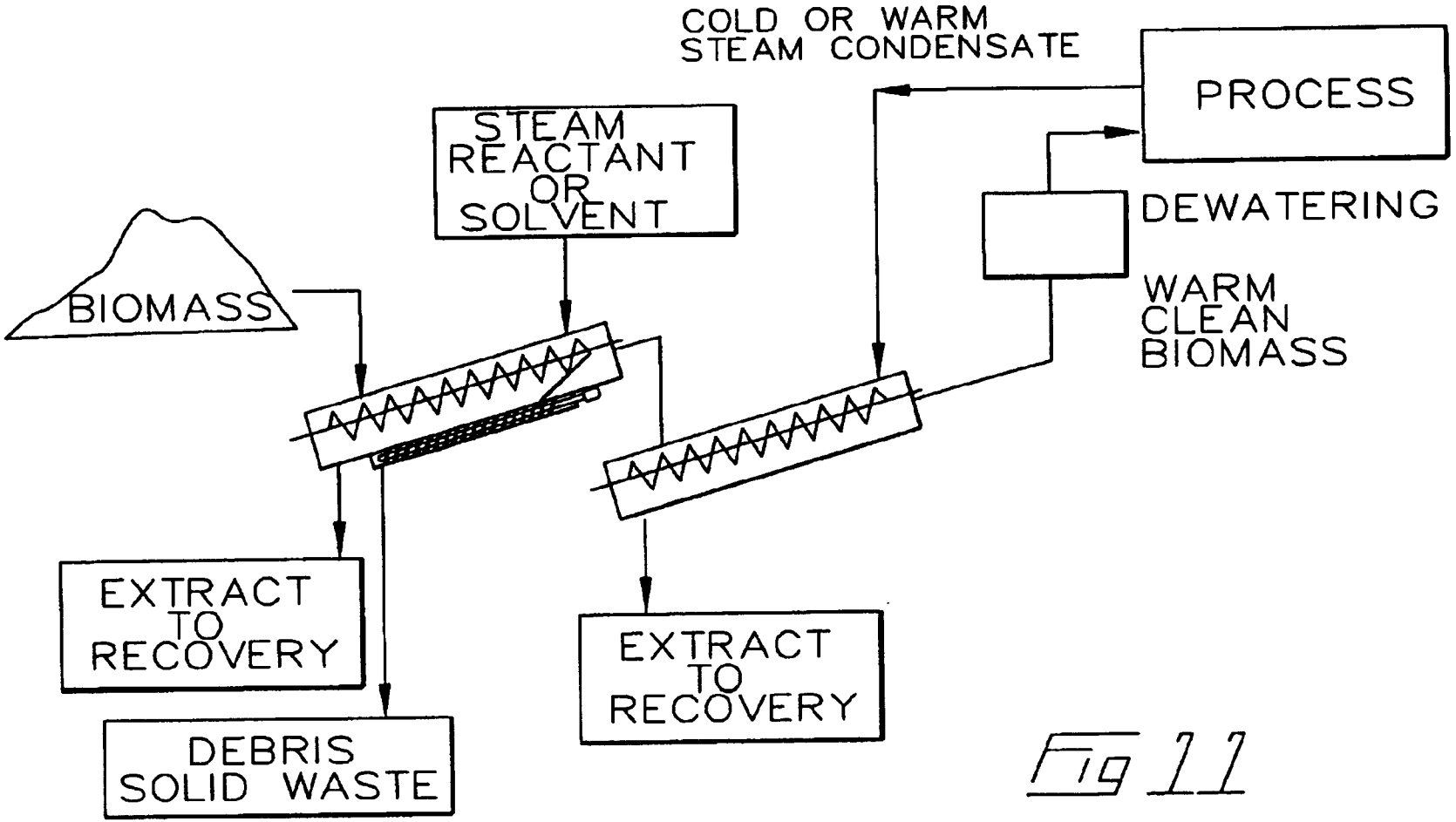
FIG. 11 is a diagrammatic view of a typical biomass cleaning according to the method of the present invention.

A further embodiment of the invention is indicated in FIG. 11. Biomass such as bagasse (sugar cane fiber), straw, wood chips, destined for conversion into bio-oil is cleaned prior to feeding into a bio-oil process, typically a Fast Pyrolysis Process. The cleaning of the biomass utilizes the principles of the hog fuel cleaning process described above, plus chemical, biological or enzyme extraction to remove undesirable compounds from the biomass feed. In this case, one or more contact stages may be used, to provide extraction of the undesired compounds, recovery of the extraction chemicals, and energy recovery.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method for reducing the creation of dioxins during the burning of a biomass containing a contaminant, wherein said contaminant is solvated or neutralized in the presence of a corresponding solvent, comprising the steps of:

a) prior to said burning of said biomass, conveying said biomass and said solvent into a biomass washing means, b) washing said biomass in said solvent in said washing means, c) once at least a portion of said contaminant has been washed from said biomass, conveying said biomass from said washing means and into a biomass burner, and conveying said solvent from said washing means.

2. The method of claim 1 wherein said biomass is hog fuel, said contaminant is salt, and said solvent is water, said method further comprising the step of supplying water to said washing means by diverting an effluent stream of heated waste water so that said heated waste water provides said solvent, whereby salt is no longer passed into said burner, and wherein stack gas precipitators collecting said particulate solids operate at lower loadings as said salt is diverted from them so as to improved combustor operations.

3. The method of claim 2 wherein said heated waste water is supplied into said washing means at a first temperature and wherein said biomass is fed into said washing means at a second temperature, and wherein said first temperature is higher than said second temperature so that said biomass cools said waste water in said washing means, whereby reduction in energy consumption in pulp and paper mills and biomass processors is achieved through warming of incoming fuel by recovery of waste heat from said effluent stream.

4. The method of claim 1 wherein said washing means is a counter-current extractor and wherein said washing includes counter-current intermingling of said solvent with said biomass.

5. The method of claim 2 wherein said washing means is a counter-current extractor and wherein said washing includes counter-current intermingling of said solvent with said biomass.

6. The method of claim 3 wherein said washing means is a counter-current extractor and wherein said washing includes counter-current intermingling of said solvent with said biomass.

7. The method of claim 2 wherein said diverting of said heated waste water is diverting of heated waster water as diverted effluent from effluent from a pulp or paper mill, and wherein said pulp or paper mill is the mill in which said biomass is to be burned, so that said diverted effluent is cooled before being disposed of in a disposal step.

8. The method of claim 3 wherein said diverting of said heated waste water is diverting of heated waster water as diverted effluent from effluent from a pulp or paper mill, and wherein said pulp or paper mill is the mill in which said biomass is to be burned, so that said diverted effluent is cooled before being disposed of in a disposal step.

9. The method of claim 4 wherein said diverting of said heated waste water is diverting of heated waster water as diverted effluent from effluent from a pulp or paper mill, and wherein said pulp or paper mill is the mill in which said biomass is to be burned, so that said diverted effluent is cooled before being disposed of in a disposal step.

10. The method of claim 7 wherein said disposal step is the disposal of said effluent, once cooled, into the ocean.

11. The method of claim 8 wherein said disposal step is the disposal of said effluent, once cooled, into the ocean.

12. The method of claim 9 wherein said disposal step is the disposal of said effluent, once cooled, into the ocean.

13. The method of claim 4 further comprising the step of providing a screw conveyor as said counter-current conveyor.

14. The method of claim 1 wherein said biomass also contains solid particulate contaminants, said method further comprising the step of removing said particulate contaminants by vibration of said solvent and biomass in said washing means.

15. The method of claim 4 wherein said biomass also contains solid particulate contaminants, said method further comprising the step of removing said particulate contaminants, by vibration of said solvent and biomass in said washing means.

16. The method of claim 15 further comprising providing an underflow conveyor cooperating with said counter-current extractor for said removing step so as to remove of said particulate contaminant from said washing means.

17. The method of claim 1 wherein said biomass is wood knots coated in chemicals rejected from a pulping process, said method comprising the steps of recovering said chemicals using a minimum flow of solvent, wherein solvent and chemicals pass out of a washing stage and are transported to a recovery system, whereby cleaned wood knots are made available for use as fuel.

18. The method of claim 5 wherein during said washing of said biomass an additional stream of effluent containing mill sludge is also added into said extractor, whereby fiber in the sludge is retained within the bed of biomass so as to act as a filter, thereby allowing cleaned water from the sludge to pass out of the washing stage along with the washing water.

* * * * *